US005681407A

United States Patent [19]

Yu et al.

[11] Patent Number: 5,681,407

[45] Date of Patent: Oct. 28, 1997

[54] METHOD OF HEAT TREATING METAL WITH LIQUID COOLANT CONTAINING DISSOLVED GAS

[75] Inventors: Ho Yu, Murrysville, Pa.; Jeffrey A. Nicol, Lakewood, Ohio; Robert A. Ramser, New Kensington; Daniel E. Hunter, Export, both of Pa.

[73] Assignee: Aluminum Company of America, Pittsburgh, Pa.

[21] Appl. No.: 400,316

[22] Filed: Mar. 6, 1995

Related U.S. Application Data

[63] Continuation of Ser. No. 63,209, May 18, 1993, abandoned.

[51] Int. Cl.[6] ..... C21D 1/613

[52] U.S. Cl. ..... 148/633; 148/635; 148/628; 148/713; 148/508

[58] Field of Search ..... 148/633, 635, 148/38, 508, 713; 266/114, 112, 96

[56] References Cited

U.S. PATENT DOCUMENTS

| | | | |
|---|---|---|---|
| 3,850,705 | 11/1974 | Furney, Jr. et al. | 148/13.1 |
| 4,166,495 | 9/1979 | Yu | 164/89 |
| 4,177,086 | 12/1979 | Bouvaist et al. | 148/12.7 |
| 4,404,044 | 9/1983 | Warchol | 148/18 |
| 4,441,937 | 4/1984 | Gossett et al. | 148/18 |
| 4,465,523 | 8/1984 | Katabuchi | 148/18 |
| 4,722,611 | 2/1988 | Hultgren | 374/43 |
| 4,738,731 | 4/1988 | Foreman et al. | 148/18 |
| 4,826,545 | 5/1989 | Foreman et al. | 148/18 |
| 4,931,108 | 6/1990 | Anzawa et al. | 148/638 |
| 4,969,959 | 11/1990 | Marr et al. | 148/20.6 |

FOREIGN PATENT DOCUMENTS

| | | |
|---|---|---|
| 126481 | 11/1984 | European Pat. Off. . |
| 321370 | 6/1989 | European Pat. Off. . |
| 57-9826 | 1/1982 | Japan . |
| 1196046 | 12/1985 | U.S.S.R. . |
| 476946 | 12/1937 | United Kingdom . |

*Primary Examiner*—Sikyin Ip
*Attorney, Agent, or Firm*—David W. Pearce-Smith

[57] ABSTRACT

A method of quenching a metal object comprising: (a) providing a reservoir of liquid coolant containing gas that has been dissolved therein; and (b) immersing the metal object in the reservoir to quench the metal. The gas is selected from the group consisting of nitrogen and carbon dioxide and is preferably carbon dioxide. The gas is preferably maintained within the range of 0.001 to 0.2 standard cubic feet of gas per gallon of coolant. The liquid coolant is preferably water. In a preferred embodiment, the reservoir of liquid coolant is open to ambient pressure and temperature.

55 Claims, 4 Drawing Sheets

METHOD OF HEAT TREATING METAL WITH LIQUID COOLANT CONTAINING DISSOLVED GAS

This application is a file wrapper continuation application of U.S. Ser. No. 08/063,209, filed May 18, 1993, now abandoned.

TECHNICAL FIELD

The present invention relates to methods and apparatus for quenching heated metal objects and to solution heat treated metal products. More particularly, the method and apparatus of the present invention relate to immersion of hot metal objects in a liquid reservoir to rapidly cool the objects and thereby improve the properties of the final product. The present methods are particularly adapted for use with heat treatable aluminum and aluminum alloys.

BACKGROUND ART

Thermal quenching is a critical step in many metal working processes. In general, the object of quenching is to preserve the solid solution formed at a solution heat treatment temperature, by rapid cooling to a lower temperature, typically near room temperature. Frequently, material is quenched by immersion in cold water or, in the continuous heat treatment of sheet, plate, or extrusions in primary fabricating mills, by progressive flooding or high-velocity spraying with a cooling medium, typically cold water.

The term "immersion" and its variations are used herein to mean submerging the material to be quenched beneath the surface of a reservoir of liquid coolant, typically water. For parts that are small enough to fit completely into an immersion vessel or tank, the term immersion is generally intended to mean that the whole part is submerged beneath the surface of the reservoir. However, it is also intended to include submerging only a section of a such part having multiple sections into the reservoir. For elongated material, such as continuous sections of slab, sheet, plate, foil and extrusion, that has at least one dimension that is too large to be submerged in an immersion vessel, the term immersion is intended to include progressively dipping a portion of a continuous material into the reservoir so that only a portion of the material is submerged in the reservoir at any given time. For elongated materials, a portion of the material may be continuously entering and simultaneously exiting the reservoir.

Metal parts having a variety of thicknesses, such as die forgings, castings, impact extrusions and components formed from sheet are commonly quenched in a medium that provides somewhat slower cooling than cold water. This medium may be water, heated within a temperature range of about 65° to 80° C. (150° to 180° F.), boiling water or an aqueous solution of polyalkylene glycol. Passing or immersing the material through each medium can have a different rate of cooling which can effect strength or other properties in the metal.

Although cold water quenching is the most common method of cooling metal, it may present problems involving residual stress and warpage. One way that residual stress in heavy sections of metal may originate is from differential thermal contraction during quenching. The magnitude of the residual stresses increases as the section size increases, as the product shape increases in asymmetry and as the cooling rate increases.

Metal removal operations, such as scalping, trimming and machining, required after heat treating often expose material that is stressed in tension. Also, metal removal operations that are asymmetrical (with respect to residual stresses) may cause distortion by redistributing residual stresses.

When close-tolerance parts are being fabricated, the resulting warpage can be costly and difficult to correct. Although service performance is sometime a factor, the major incentive for reducing residual stress differentials has been a reduction in warpage during machining or an improvement in shape before machining. Warpage of thin sections during quenching may also be a problem.

One approach to reducing the cooling-rate differential between different sections of a part is the use of a milder quenching medium-water that is hotter than that normally used or water-polymer solutions. Boiling water, which is the slowest water quenching medium used for thick or thin sections, is sometimes employed for quenching wrought products even though it may lower mechanical properties and corrosion resistance of the final product.

Another development for reducing straightening costs is quenching in water to which organic additives such as polyvinyl-alcohols, alkylene-glycol or glycerol have been added. Quenching with solutions containing organic additives has significantly reduced the cost of straightening these parts after quenching. These solutions, although effective, are costly and present environmental concerns when disposing of the solutions. In addition, they often leave a film on the surface of the quenched piece. This film must be removed which necessitates an additional washing step. For quenched metal pieces with open interior surfaces, the removal of the film during the washing step may be quite complicated. Disposal of the wash fluid is another cost.

Some prior art alternatives to water quenchants are found in U.S. Pat. Nos. 4,969,959; 4,722,611; 4,441,937; 4,404,044; 4,177,086 and 3,850,705.

Accordingly, it would be advantageous to provide an economical and effective quench solution and method of quenching metal that results in less residual stress and warpage than cold water and that minimizes environmental concerns associated with quench solution disposal.

The primary object of the present invention is to provide a method and apparatus for solution heat treating metal with reduced residual stresses and warpage without detrimentally affecting strength in the treated product.

Another objective of the present invention is to optimize the quenching by providing a quenching medium that has a slow rate of cooling during the first stage of quenching when the metal is plastic and a more rapid rate of cooling during the later part of the quench when the metal is cooler and less plastic.

Another object of the present invention is to provide a method for quenching thin sections of metal within previously unattainable tolerances and thereby reducing, and often eliminating, the need to perform conventional post-quenching dimensional corrective operations.

Another objective of the present invention is to provide a quenching medium that does not often leave a film on the surface of the quenched piece and thus eliminates the need for a post-quench cleaning step.

Another object of the present invention is to provide recyclable and environmentally friendly additive for slowing the quenching rate of cold water that has a lower adverse environmental impact than organics such as polyalkylene glycol.

A further object of the present invention is to provide a method and apparatus that can be readily added to existing fabrication facilities without creating additional environmental concerns.

Yet another object of the present invention is to provide a method and apparatus that can be readily added to existing quenching facilities that permits the quenching of metal with a larger width to thickness ratios than has heretofore been commercially feasible.

These and other objects and advantages of the present invention will be more fully understood and appreciated with reference to the following description.

SUMMARY OF THE INVENTION

A method of quenching a metal object comprising: (a) providing a reservoir of liquid coolant containing gas dissolved therein; and (b) immersing a metal object in the reservoir to quench the metal. The liquid coolant is most preferably water. The gas is preferably selected from the group, that is highly soluble in water liquid, consisting of ammonia, nitrogen, carbon dioxide and mixtures thereof. The gas is most preferably carbon dioxide.

Another aspect of the present invention is an apparatus for quenching metal. The apparatus comprises: (a) vessel for holding liquid coolant; and (b) a mixing means for dissolving gas into the liquid coolant. The apparatus may also include (c) a feed conduit means for transporting liquid coolant from the mixing means to said vessel. In addition, the vessel may also include an inlet means located above a bottom wall for receiving the liquid coolant containing dissolved gas. The inlet means has at least one orifice for distributing incoming liquid coolant from the first conduit means.

In a preferred embodiment, the apparatus includes a conduit means for transporting liquid coolant from the vessel to the mixing means. In this embodiment, the liquid coolant is recycled into the mixing chamber to dissolve additional gas into the coolant so as to decrease the coolant's quenching heat transfer. The refortified liquid coolant is then transported back to the vessel so that it can be reused.

Alternate preferred embodiments, may include one or more of the following:

(1) A mixing means having an inlet for pressurized air to strip dissolved gas from coolant that is being recirculated into the vessel. The mixing means may be located inside or outside of the reservoir.

(2) A feed means for introducing new coolant material into the closed system. New coolant may be used to replace coolant lost via evaporation. New coolant can also be introduced to lower or raise the temperature of the coolant being transported to the vessel.

(3) A heating pump means for heating or cooling the coolant. The heat pump may be located in the vessel or in the conduits.

A second method of the present invention is the quenching of a metal object by (a) providing a solution of liquid coolant containing gas that has been dissolved therein; and (b) spraying the solution onto the metal object for a sufficient time to quench the metal. As with the first method, the gas is most preferably carbon dioxide and the liquid coolant is preferably water. This method is particularly advantageous in quenching a continuous sheet of metal or an elongated extrusion that has been heat treated.

Another aspect of the invention relates to an apparatus useful for spray quenching continuous metal such as metal emerging from an extrusion mold or metal that has been rolled into sheet, foil or plate. The apparatus comprises: (a) a gas mixing means to dissolve gas into the liquid coolant; and (b) a spraying means for spraying liquid coolant onto metal. The apparatus may also comprise (c) a feed conduit means for transporting liquid coolant from the mixing chamber to the spraying means in the event that the mixing means and the spraying means are not adjacent to each other.

The methods and apparatus of the present invention may be employed to quench a variety of diverse metals and are particularly adapted for use with aluminum and aluminum alloys. In addition, the method is useful in quenching metal formed from various metal forming processes including rolling, casting, extrusion and forging.

BRIEF DESCRIPTION OF THE DRAWINGS

Other features of the present invention will be further described in the following related description of the preferred embodiment that is to be considered together with the accompanying drawings wherein like figures refer to like parts and further wherein.

MODE FOR CARRYING OUT THE INVENTION

The term "dissolved gas" is used herein to mean gas that has been injected into a fluid under pressure greater than atmospheric pressure or otherwise deliberately or artificially added.

The phrase "fluid containing a dissolved gas" and variations thereof are intended to include fluids that contain levels of dissolved gas above the levels that normally occur in nature. For example, although plain water such as tap water, lake water, river water and the like, which is commonly used to quench metal, may contain amounts of gas, plain water is not intended to be a fluid containing gas. However, carbonated water, which does occur naturally, heretofore has not been used to quench metal and is intended to be a fluid containing dissolved gas for the purpose of the present invention.

The term "thin walled parts" as used herein is intended to mean metal that has at least one section with a dimension (e.g., length) at least about an order of magnitude larger than one of its other two dimensions. Typically, a thin walled part will be a rolled product having a length that is much greater than its thickness or width. Forgings or extrusions are typically considered to be thin walled if the cross sectional thickness through one of its walls is at least an order of magnitude smaller in one direction than it is in another direction.

Figure 1:
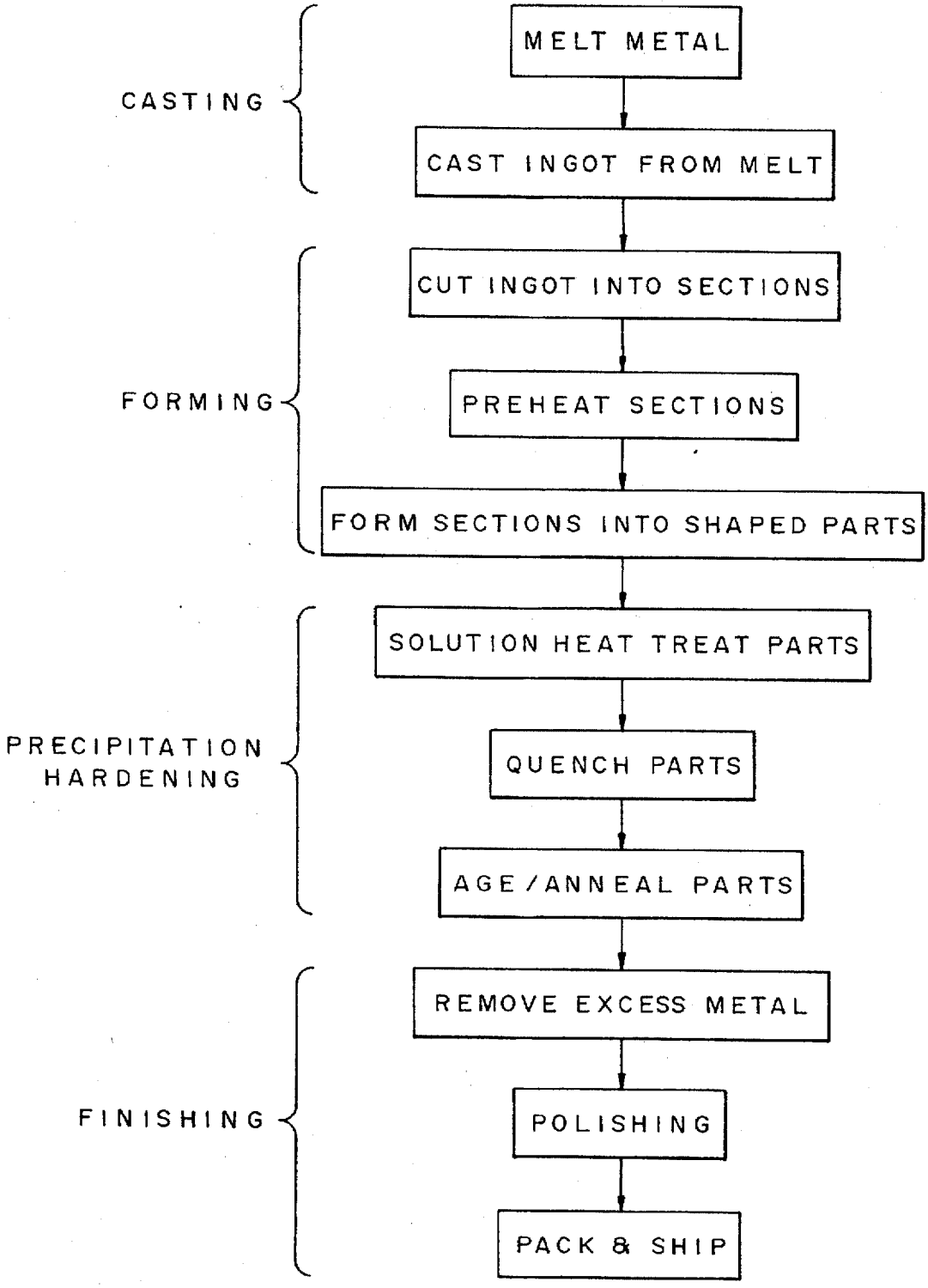
FIG. 1 is a flow chart illustrating major steps in the fabrication of a quenched metal object.

Turning first to FIG. 1, there is illustrated a flow chart of major steps in the fabrication of formed metal object. These steps are particularly adapted for use in the thermal quenching of aluminum and aluminum alloy surfaces but may also be employed in the thermal quenching of various other types of metal parts. The steps are generally known in the art and for convenience can be divided into the broad categories listed on the left side of FIG. 1. Each of these broad categories contains many process steps. At least two representative process steps are listed for each of these broad categories. The present invention is directed to methods and apparatus involved in the solidification of metal and more specifically with the process step of quenching a shaped part.

Metal alloys, such as aluminum alloys, have traditionally been subject to treatments for enhancing properties, such as strength and hardness. The treatment is referred to in the art as precipitation hardening and as is illustrated in FIG. 1, includes the substeps of dissolving, quenching and annealing or aging. Precipitation hardening is preceded by solution heat treating the metal. During this stage, at least some of the intermetallic compounds, which have formed in the metal, are dissolved and brought into solid solution. While the specific times and temperatures associated with solution heat treatments depend on the particular alloy being treated, most parts formed from aluminum alloys are solution heat treated at one or more temperatures ranging from about 800° F. (427° C.) to about 1100° F. (593° C.).

Next, the solution treated metal is removed from the solution heat treating furnace and quenched (before the metal has had an opportunity to cool to the alloys critical temperature), typically with water, to room temperature. Quenching cools the alloy to a second temperature that is lower than the heat treating temperature. Typically, this second temperature is less than 400° F. (204° C.) and preferably less than 250° F. (121° C.). The temperature change of the piece during quenching is so rapid that most of the elements that were dissolved during the preceding solution heat treatment do not have time to precipitate. The quenching process is a part of the solution heat treating process that thus produces a super-saturated metastable solid solution.

The rate of cooling of metal during the quenching operation can have a pronounced effect on both amount of residual stress and the final mechanical properties of the aged parts. An optimum quench path is one that results in maximum mechanical properties and minimum residual stress and distortion. This ideal is best accomplished by a quench which is: (a) slow through the first phase of the quench until the part reaches the upper bound of an alloy specific temperature range, known as the critical temperature range; and (b) rapid through the critical temperature range. This quench path limits the stress inducing fast quench to the temperature range where it is needed.

The first phase of the quench, when the metal is at its highest temperatures and thus most plastic, is considered to be a significant time period with respect to residual stress development. It is desirable for a coolant to have a slow rate of thermal transfer during this first phase of the quench until the metal reaches the upper bound of the critical temperature range. If the part is cooled too quickly during this first phase of the quench, the part could develop internal stresses that may cause undesired thermal distortion, especially in thin walled objects that have little thermal inertia. As a general rule, the slower the metal is cooled to the upper bound of the critical temperature range, the lower will be the amount of residual stress formed in the part.

After reaching the upper bound of the critical temperature range, the part enters the second phase of the quench wherein rapid cooling is desirable. The length of time that the metal remains in the critical temperature range is dependent on the composition of coolant used during the quench, the amount of coolant used, the temperature of the coolant used and the thickness of the part. As the metal is being cooled through the critical temperature range, it is preparing to develop its mechanical properties such as yield/tensile strength, fracture toughness and corrosion resistance after aging. Thin walled sections, having little thermal inertia, are cooled quickly and may spend less than a second in the critical temperature range. Thicker parts, having greater thermal inertia, may spend minutes in the critical temperature range.

As stated above, the critical temperature range is alloy specific, e.g., it varies according to the chemical composition of the alloy. Aluminum alloys, such as AA 6061, AA 7075, AA 7050, require a rapid cooling through a temperature range of 750°–550° F. to develop their mechanical properties.

After passing through the critical temperature range, it is desirable to return the process to a slow rate of cooling to or near room temperature. The rate of cooling that the metal experiences during this third phase of the quench is less critical than the rate of cooling during the first two phases.

Cold water, having a temperature of about 70° F. (21° C.), has been found to be very effective as a coolant for quenching metal and can be considered the standard for comparing the quench rates of other coolants. Cold water, i.e., 70° F., is not an ideal coolant because it produces rapid cooling during both the first and the second phases of the quench. For parts having a thin wall, the internal stresses developed in the first portion of a quench using cold water may cause the part to warp.

Warm water, having a temperature of about 150° F. (66° C.), is known to be more effective than cold water in reducing the excess residual stress during the portion of the quench and may eliminate the thermal distortion in parts having thin walls. However, the slower cooling effect of warm water increases the time that the part remains in the critical temperature range that can result in less than optimum mechanical properties for many alloys.

In addition, warm water quenching is considered not to be very consistent and the reduction in stress may vary within a workpiece or from workpiece to workpiece. Furthermore, warm water quenching is sensitive to a variety of workpiece conditions such as surface finish.

If a warm quench medium could be replaced by a colder quench medium during the quenching process prior to the critical temperature phase of the quench, parts could be fabricated which have low residual stress and good mechanical properties. Replacing the warm quench water with cold water during the quenching process or changing the water temperature during immersion quenching is a formidable undertaking. Quench tanks contain a fluid reservoir, generally water, that is too large to allow rapid changing of its temperature. It is impractical to attempt to change the temperature of a tank filled with over 1,000 gallons of warm water having a temperature of about 150° F. to cold water having a temperature of about 70° F. in a fraction of a second.

Those skilled in the art, in their desire to avoid inducing excess internal stress in the workpiece, often settle for a less than optimum quench. Organic additives, such as those discussed above, have been successful in reducing the rate of cooling during the first phase of the quench. However, they also retard the rate of cooling in the critical temperature range during the second phase of the quench.

The challenge in the art is to find a quenching medium that has the best combination of a slow rate of cooling similar to that of warm water during the first phase of the quench when the metal temperature is the highest and plastic, and a more rapid rate of cooling during critical temperature range when the metal is cooler and less plastic.

Surprisingly, it has been found that if gas, such as $CO_2$, is dissolved into cold water then the rate of thermal cooling during the initial rapid phase of an immersion quench is similar to that of a warm water quench and yet during the later critical phase of the quench the quenching medium acts similar to that of cold water that does not contain any intentionally dissolved gas.

Although not wishing to be bound by any theory, it is believed that a $CO_2$ vapor insulation layer forms on the surfaces of the metal shortly after the metal is immersed or submerged in a carbonated water reservoir. It is believed that the heat from the hot metal causes localized evaporation or nucleate boiling of the water in response to contact with the hot surface of the metal. The water vapor and the $CO_2$ form small bubbles that coalesce and form a layer of small bubbles on the surface of the metal exposed to the water. These small bubbles are typically sized in the order of a few hundred microns from about 100 to about 350 microns. These small bubbles are believed to be filled with gaseous $CO_2$. The layer is believed to act as an insulation layer that separates the metal from the quench medium and thereby retards the rate of heat extraction (or thermal cooling of the metal otherwise effected by the cooling medium). The layer forms as a gaseous blanket on the surface of the metal when the metal is at a relatively high temperature.

It is further believed that the surface of the metal is uniformly coated by the film and that the entire surface of the metal workpiece exposed to the $CO_2$-containing water experiences this effect of film insulation. The $CO_2$ bubbles are believed to boil off the surface and break away or erode during the quenching process. However, it is further believed that the eroding layer of vapor is constantly being replaced by new bubbles that continue to be formed from gaseous evaporation so long as the metal workpiece is above the boiling point of carbonated water. The bubbles that break away from the surface of the metal workpiece are believed to be reabsorbed into the cold water as they float toward the surface of the reservoir. Very little bubbling is observed at the surface of the water in the reservoir.

As long at the surface temperature of the metal remains above the boiling point of the carbonated water, new bubbles continue to be formed which adhere to the metal surface and insulate the metal from the cold water and thus retard the rate of cooling so that the rate of cooling of the reservoir of cold water is approximately the same as that of warm water. As the metal workpiece continues to cool, the rate of new bubble generation decreases and the insulation layer gradually deteriorates and the cold water makes direct contact with the surface of the metal.

As the metal continues to cool, vaporization of the dissolved $CO_2$ no longer occurs and the rate of cooling of the dissolved solution containing $CO_2$ approximates that of typical cold water quenching, i.e., the presence of dissolved $CO_2$ gas in the water is no longer a significant factor in the rate of cooling.

A preferred coolant for quenching is water and a preferred gas is $CO_2$. Water is a preferred coolant because it is inexpensive and available. $CO_2$ is preferred because it is odorless, relatively inexpensive, highly soluble in water. In addition, since there is no gaseous buildup in the recycled water $CO_2$ does not suffer from many of the disadvantages associated with chemical additives such as polyalkylene glycol.

Figure 2:
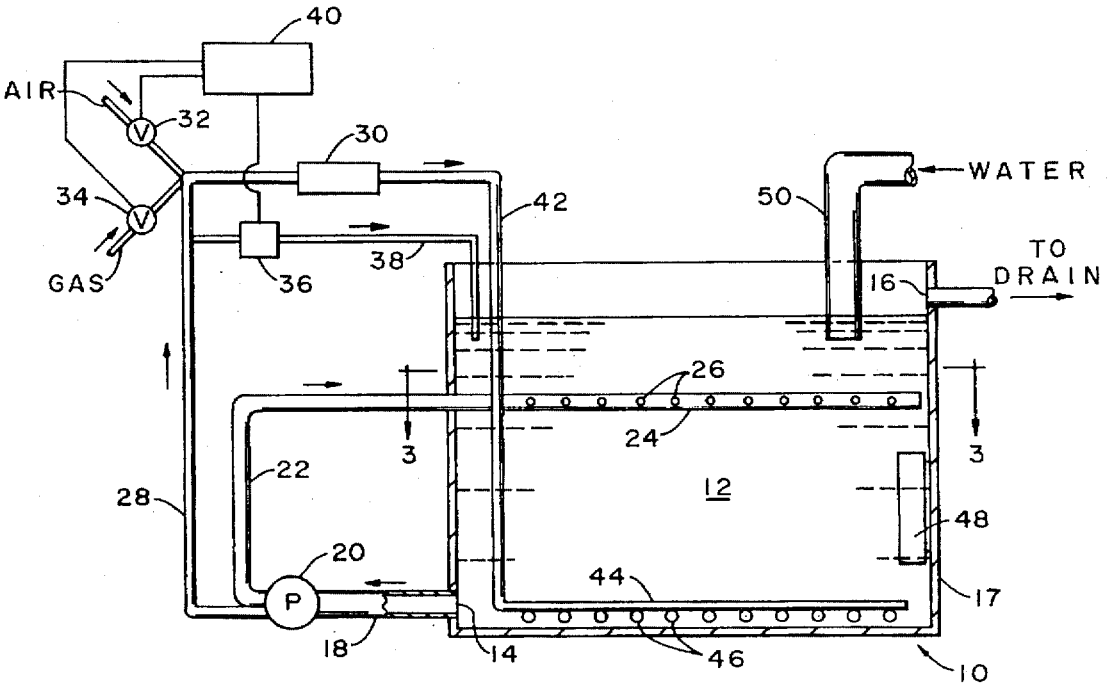
FIG. 2 is a side view of the immersion tank apparatus of the present invention.

FIG. 2 is a side view (in partial cross section) of an apparatus used in practicing the present invention. The apparatus comprises vessel 10, which is an open tank for holding a reservoir of fluid 12. The term "open tank" is used herein to mean that no provisions are made to provide greater than or less than atmospheric pressure on the reservoir of fluid held in the tank or to prevent heat from escaping. Fluid 12 is preferably water.

Vessel 10 has an exit port 14 near its bottom for removing fluid from the tank and an overflow port 16 located near the top of one of the sidewalls 17 of vessel 10. Overflow port 16 can be connected to a drain (not shown) for eliminating fluid from the system.

Exit port 14 is connected to Conduit 18 that contains a pump 20 which pressurizes the water and circulates a large portion of it back into vessel 10 via conduit 22 and disperser 24. Disperser 24 is a conduit with ports 26 for distributing water entering vessel 20.

Pump 20 also pressurizes and circulates a smaller portion of the water into conduit 28 which leads to a static mixer 30 for dissolving $CO_2$ into the water, or alternatively for injecting air into the water to strip it of dissolved gases prior to recirculating the water into vessel 10. Entrance of the air and gas into the conduit is controlled by control valves 32 and 34, respectively which are located downstream from gas sensor 36 and upstream from the static mixer 30. As explained above, $CO_2$ is the preferred gas and cold water is the preferred fluid. Carbon dioxide is very soluble in water.

Gas sensor 36 determines the amount of gas that is currently dissolved in the fluid flowing in conduit 28. The means by which the gas sensor 36 determines this level is well known and is not critical to the invention. A commercially available infrared spectrometer calibrated to detect carbon dioxide has been found to be useful. However, those skilled in the art will recognize that other means existing or now developed for detecting and quantifying the amount of gas in solution can also be used. Such devices include, but are not limited to, devices that rely on permeation of gas through a membrane, or through changes in the resistance or electrical conductivity of the fluid. Fluid passing through sensor 36 is directed through conduit 38 into tank 10.

Output from gas sensor 36 is sent to microprocessor 40 which compares the amount of gas currently in solution to a reference signal or range of signals. On the basis of this comparison, microprocessor 40 sends a command signal to a control (not shown) on control valves 32 and 34 to adjust, and even stop, the flow of air and/or gas into the system in response to an output signal from a gas sensor 36. The command signal will cause the appropriate valve to change appropriately. Since microprocessor 40 is continuously comparing the signal from sensor 36 to a reference signal, the opening in valves 32 and 34 will be changed by successive increments until the signal is within the reference range.

Gas and or air is dissolved in the water inside static mixer 30. Static mixer 30 contains internal baffles which rotate and assist the air to dissolve in the gas in dissolving into the water. Static mixers are well known in the art and are commonly used to inject gas into a fluid under pressure, and thereby dissolve gas into the fluid. The exact amount of gas that is dissolved into the water will depend on the water temperature and the flow of pressurized gas. It is preferred that flow of gas into the water be set at a level in which water will be saturated with gas at pressures near atmospheric pressure. The amount of gas needed to accomplish this may be as low as 0.001 SCF gas per gallon of water. If the water is super-saturated with gas, excess gas beyond the saturation point will be released as bubbles in vessel 10 since vessel 10 is an open tank.

Figure 3:
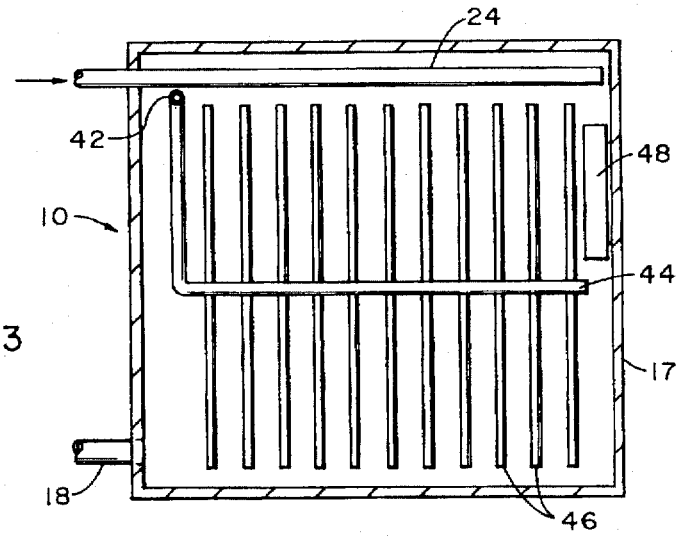
FIG. 3 is a sectional top view of the immersion tank shown in FIG. 2 through line IV—IV.

The gas containing fluid is transported from static mixer 30 via conduit 42 to vessel 10 where it enters the tank. The gas containing fluid is then transported to a manifold system which comprises a feeder conduit 44 and parallel pipes 46 located near the bottom of the vessel 10 (shown best in FIG. 3). Pipes 46 contain a series of outlets for releasing the gas containing fluid in vessel 10 and creating a mixing flow within the tank.

The fluid in vessel 10, the pressure on the fluid drops to atmospheric pressure. As stated above, vessel 10 is an open tank and the reservoir of fluid contained therein is not confined in a manner that would cause the fluid to be pressurized and therefore retain more of the gas that has been intentionally dissolved therein. Excess gas (i.e. gas dissolved in concentrations greater than the saturation point of carbon dioxide at atmospheric pressure) is released and forms bubbles which rise to the surface of the reservoir. Heretofore, it was not imagined that one could keep sufficient amounts of $CO_2$ in solution to allow one to use carbon dioxide to retard the rate of cooling in an immersion tank.

Heat pump 48 is an optional feature of the invention and is not considered to be essential to practicing the invention. If it is used, it is preferably located in tank 10. Heat pump 48 may be useful in maintaining the reservoir of water at a desired temperature. A microprocessor and temperature controls (all not shown) may be used to automatically maintain a reservoir temperature. In addition, heat pump 48 can be used to preheat the water prior to quenching. Warm water can be used to stabilize the quench. In addition, carbon dioxide is soluble in warm water (150°–200° F.) and the process of the present invention can be used with warm water as well as cold water or at temperatures therebetween.

Cold water can be useful to counteract the rise in water temperature associated with quenching hot metal. If needed, water inlet conduit 50 brings cold water from a water supply into the vessel 10 and overflow port 16 releases excess water to a drain (not shown). An additional source of pressurized air and a static mixer (all not shown) can be used to strip any dissolved gasses from the water exiting port 16 prior to its release into a waste disposal or recycling system.

In operation, vessel 10 is filled with water. Water exiting via port 14 is pressurized in pump 20 and the flow is divided into two portions. The largest portion comprising approximately 70% of the water entering the pump is directed to conduit 22 where it is transported back into vessel 10 and dispersed via disperser 24 through ports 26. The flow pattern created by disperser 24 keeps the water in tank 10 circulating and helps to disperse local hot spots of water within the tank.

The remainder of the water exiting the pump 20 is directed to conduit 28 where a small portion is sampled to determine the level of gas that is dissolved therein. The sampling is the result of water flowing into sensor 36 and a signal will be sent to microprocessor 40. Depending on whether the reference values in the microprocessor and the output from sensor 36, the microprocessor will send command signals to the control valves to appropriately adjust them.

To quench with an aqueous solution containing carbon dioxide, it is preferred that reference range be set such that the amount of carbonation in the water can vary from 0.001 to 0.2 standard cubic feet (SCF) gas per gallon of water depending on water temperature. As a general rule, the warmer the temperature the less carbonation is required to produce the desired effect. Heat pump 48 can be used to maintain or raise the initial temperature of the water and thus conserve carbon dioxide gas. Once the desired level of carbon dioxide is reached, parts can be lowered into the reservoir in a basket or any other method known in the art. It is contemplated that for most practices the parts will be entirely submerged beneath the surface of the water. Preferably, the parts will be lowered to a level well below the surface of the water reservoir to minimize the creation of hot spots in the water between the parts and the surface of the reservoir.

In the start up mode, the water may typically contain little or even no carbon dioxide and the microprocessor sends a command signal to control valve 32 to remain closed and a signal to control valve 34 to open. This process is repeated until the level of dissolved gas is detected as being within the desired range. Excess gas in the water is released as bubbles in the tank and does not adversely effect the process or contribute to quench rate retarding. Thus, if bubbling appears at the water surface of the reservoir, the amount of carbon dioxide gas being injected to the water may be reduced by lowering the upper limit of the reference range. Alternatively, control valve 34 can be closed manually until little or no bubbling appears at the surface of the reservoir.

It should be noted that carbon dioxide gas is slowly escaping from the water in vessel 10 and rising to the surface. Since $CO_2$ is heavier than air, a blanket of $CO_2$ forms on the top surface of the reservoir. This blanket slows the rate of $CO_2$ loss from the tank into the air. To keep $CO_2$ loss to a minimum, care should be taken not to disturb this gaseous blanket.

Once the level of $CO_2$ in the water is in a desired range the part(s) may be immersed in the reservoir without any special considerations. Optionally, the immersed parts may be agitated while they are submerged to promote dispersion of the bubble layer formed on the surface of the parts. In addition, the turbulence resulting from agitation of the parts may also minimize the formation of local hot spots in the reservoir. The parts may be agitated for the entire time that the parts are immersed in the vessel 10 or for only a portion of the time.

Fluid overflow resulting from water displacement of the parts being quenched, exits the vessel 10 via overflow port 16. The water flowing in conduit through overflow port 16 may either be recycled or discharged into an appropriate waste disposal system. As stated above, carbon dioxide-containing water does not pose an environmental concern. In the event that it is desired to remove the dissolved carbon dioxide from the water prior to transporting it to an appropriate recycling or waste 26 system, pressurized air may be mixed with the water to strip it of its dissolved gas.

After carbon dioxide/water quenching, the tank may be quickly restored to its normal cold water quench conditions (i.e. containing little or no dissolved gas). If the reference range is set at zero, the microprocessor signals the control valve 34 to close. This stops the flow of additional gas into the tank. However, since the gas remains in the water for a while, the microprocessor can be programmed to send an additional command signal to control valve 32 to open and thus add pressurized air to the water flowing into the static mixer 30. As stated above, injecting air under pressure strips the water of the majority of the $CO_2$. The shipped water can then be circulated into the quenching tank to return the tank conditions to normal rapid cold water quenching.

The water temperature can be reduced by adding cold water via conduit 50. This causes water to enter overflow port 16. A microprocessor and temperature sensor can be used (not shown) to automatically control the water temperature.

Microprocessor 40 can instantaneously calculate the optimum flow rate for gas to bring the signal within the reference range. In addition, multiple reference ranges can be programmed into the computer for different quenching practices. As stated above, the reference range can be set to zero to ship all the dissolved gas from the water and return to the normal quench mode.

Figure 5:
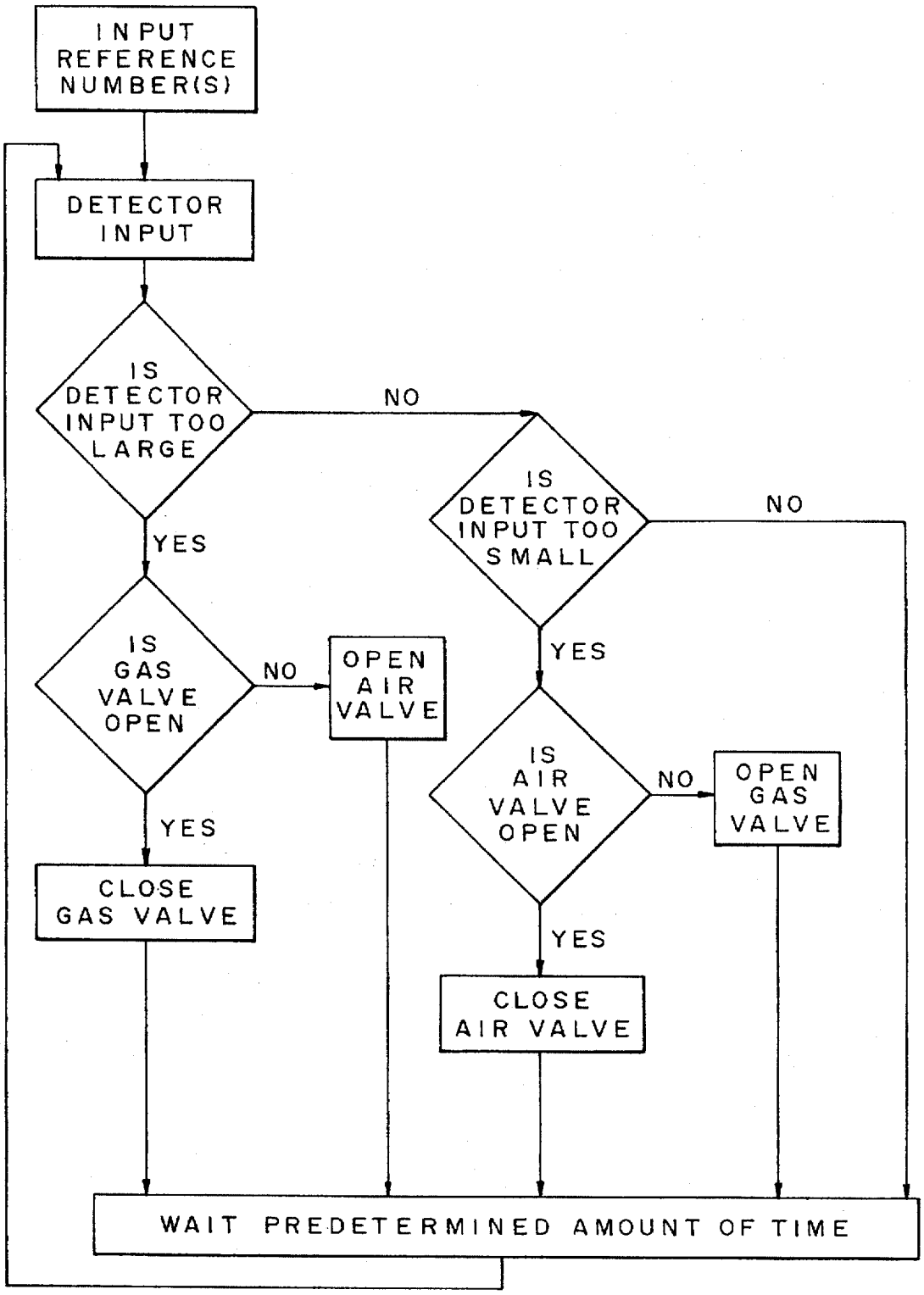
FIG. 5 is a logic and process flow diagram showing decisions of a process of automatically maintaining the level of dissolved carbon dioxide within a predetermined range by controlling the amount of air and gas flowing into the static mixer.

Air is known to strip carbon dioxide flow from water and the computer can be programmed to most efficiently utilize carbon dioxide. One such program is shown in FIG. 5. Turning next to FIG. 5, there is illustrated a logic and process flow diagram showing decisions of the process of automatically maintaining the level of dissolved carbon dioxide within a predetermined range. Essentially the procedure followed in the process include the following steps:

(a) Imputing an upper and lower reference value in microprocessor 40.

(b) Imputing a signal from gas detector 36 into the microprocessor.

(c) Determining if the input signal from the sensor is within the reference range stored in the microprocessor.

(d) Sending a command signal to a control device to open gas valve 34 by a predetermined amount so as to upwardly adjust the flow of gas that is being dissolved into the liquid coolant, if the signal from the sensor is smaller than the lower reference value.

(e) Sending a command signal to a control device to open air valve 36 by a predetermined amount so as to remove some of the gas that has been dissolved in the liquid coolant, if the signal from the sensor is larger than the upper reference value.

(f) Sending no command signals to the valves, if the signal from the sensor is within the reference range.

(g) Waiting a predetermined length of time.

(h) Repeating steps (b) through (h).

Figure 4:
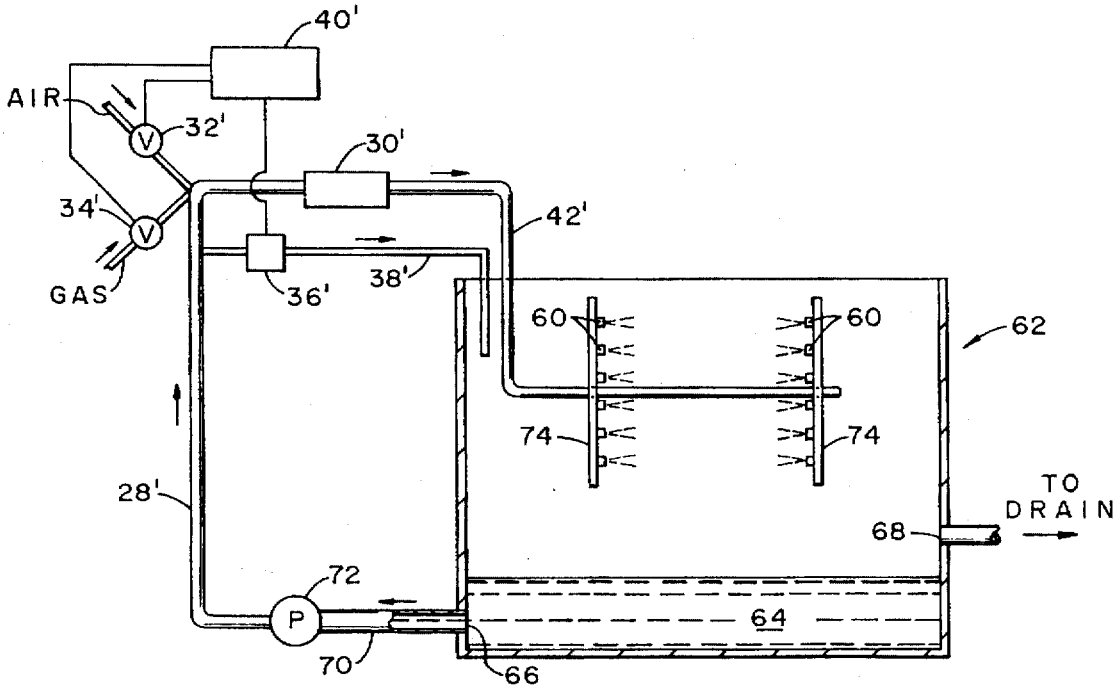
FIG. 4 is a side view of an alternative embodiment of the present invention which includes a spraying means.

Turning next to FIG. 4, there is illustrated an alternate apparatus of the present invention. The apparatus of FIG. 4 is similar to that of FIG. 2 except that spray heads 60 are used to spray coolant containing dissolved gas onto the part and thereby quench the material.

The spray apparatus of FIG. 4 comprises vessel 62, which is an open tank for collecting fluid 64 which is preferably water. Vessel 62 has an exit port 66 near its bottom for removing fluid from the tank and an overflow port 68. Overflow port 68 can be connected to a drain leading to a recycling or disposal system.

Exit port 66 is connected to conduit 70 which contains a pump 72 which pressurizes the water and circulates the water into conduit 28' which leads to a static mixer 30' for dissolving $CO_2$ into the water, or alternatively for injecting air into the water. The entire output from pump 72 is circulated into conduit 28'.

As with the embodiment shown in FIG. 2, entrance of the air and gas into conduit 28' is controlled by control valves 32' and 34', respectively which are located downstream from gas sensor 36' and upstream from the static mixer 30'. Gas sensor 36' determines the amount of gas that is currently dissolved in the fluid flowing in conduit 28'. The means by which the gas sensor 36' determines this level is well known and is not critical to the invention. Fluid passing through sensor 36' is directed through conduit 38' into vessel 62.

Output from gas sensor 36' is sent to microprocessor 40' which compares the amount of gas currently in solution to a reference signal or range of signals. On the basis of this comparison, microprocessor 40' sends a command signal to a control (not shown) on control valves 32' and 34' to adjust, and even stop, the flow of air and/or gas into the system in response to an output signal from a gas sensor 36'. The command signal will cause the appropriate valve to change appropriately. Since microprocessor 40' is continuously comparing the signal from sensor 36' to a reference signal, the opening in valves 32' and 34' will be changed until the signal is within the reference range.

Gas and or air is dissolved in the water inside static mixer 30'. Static mixer 30' contains internal baffles which rotate and assist the air to dissolve in the gas in dissolving into the water. The gas containing fluid is transported from static mixer 30' via conduit 42' to feeder conduit 74 containing parallel rows of spray heads 60 for releasing the gas containing fluid over vessel 62. The pressure on the fluid exiting spray heads 60 drops to atmospheric pressure.

Spray heads 60 create a curtain of carbonated water above the tank. Parts can be lowered to level where their exterior surfaces can be soaked with fluid and thereby quench them. Fluid 12' is collected into vessel 62 and may be recycled into the static mixer or diverted to a recycling or disposal system.

The benefit of the present invention is illustrated in the following examples. The first three examples were performed for the purpose of comparison.

EXAMPLE 1

A quench tank having an approximate capacity of 35 gallons (4.7 $ft^3$) was constructed with a gas manifold on the floor of the tank. The tank was filled with water having an initial temperature of approximately 70° F. (21° C.) and was designed with a manifold near the bottom of the block for circulating the cooling medium (water). A block of aluminum alloy 7050 having dimensions of 4.75×1.5×12 inches was heated to a temperature of about 900° F. (482° C.) and quenched in the tank. As stated above, AA 7050 requires a rapid cooling through a temperature range of about 750°–550° F. (399°–288° C.) to develop their mechanical properties. A thermocouple was fixed to the center of the block.

Figure 6:
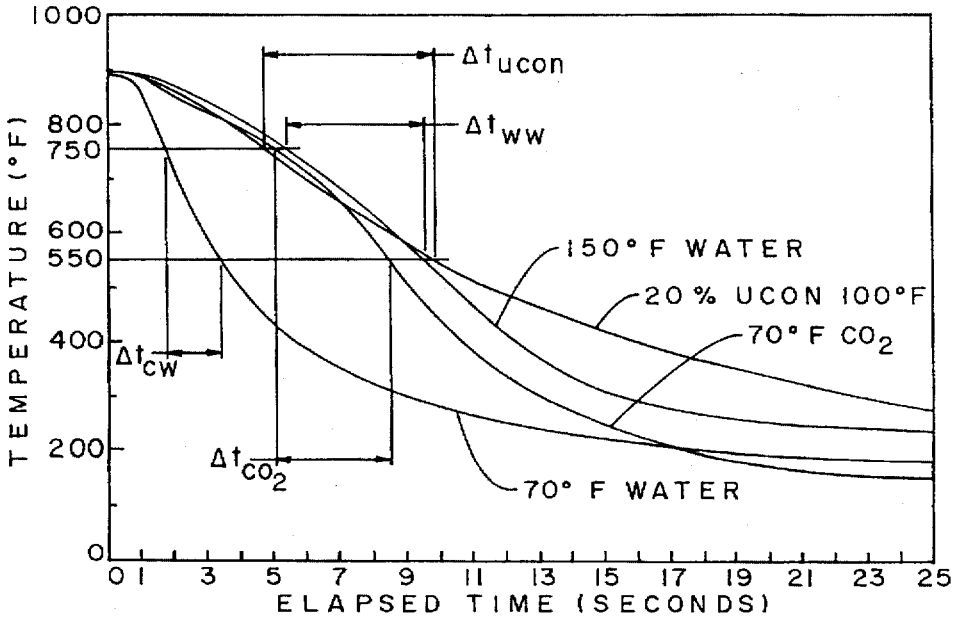
FIG. 6 is a graph of thermal quench data comparing the cooling rates of various prior art liquid coolants and the liquid coolant of the present invention on a quenched 4.75 inch×1.5 inch×12 inch section of AA 7050 aluminum alloy block.

The block was placed in a furnace to simulate the solution heat treatment that precedes quenching. After the block was heated to a uniform temperature, it was removed from the furnace and immediately submerged in the cold water quenching solution and allowed to sink to a level several inches above the floor of the tank. The part was not agitated during the quench. The thermal cooling experienced at the center of the block was measured with the thermocouple, continuously recorded and plotted to provide the curve of FIG. 6 of the accompanying drawing. FIG. 6 is a plot of temperature verses time comparing different quenching medium.

As is shown in FIG. 6, the cooling rate of the center of the block during the entire quench is quite rapid (the slope of the curve being steep). The rate of cooling during the portion of the quench above the critical temperature range was about 86° F. per second (150° F./1.75 seconds). The high rate of cooling that the block experiences above 750° F. may be considered too high for parts containing thin walls. The rate of cooling during the critical temperature range (shown as $\Delta t_{cw}$) was about 121° F. per second (200° F./1.65 seconds).

EXAMPLE 2

The procedure of Example 1 was repeated except that a hot water reservoir having an initial temperature of 150° F.

(66° C.) was used to quench the same aluminum block after it was reheated. The thermal cooling experienced at the center of the block was measured, recorded, plotted and illustrated in FIG. 6.

As is shown by the gentle slope of the plot in FIG. 6, the cooling rate at the center of the block of Example 2 above the critical temperature range and during the critical temperature range is not as rapid as that of Example 1. The rate of cooling during the portion of the quench above the critical temperature range was about 30° F. per second (150° F./5 seconds). The center of the block remained above the critical temperature range for a period of time that was about 2.8 times that of cold water (Example 1). Thus, there is a desirable reduction in residual stresses caused by quenching above the critical temperature range.

However, the gentle slope of the plot of Example 2 continues in the critical temperature range. The rate of cooling during the critical temperature range was about 44.4° F. per second (200° F./4.5 seconds). The length of time that the block remains in the critical temperature range ($\Delta t_{ww}$) is more than 2.5 times longer than $\Delta t_{cw}$. As explained above, this is considered undesirable and is believed in the art to be associated with reduced mechanical strength in the subsequently aged workpiece.

EXAMPLE 3

The procedure of Example 1 was repeated except that an aqueous solution having an initial temperature of 100° F. (38° C.) containing 20 wt. % UCON™ (polyalkylene glycol) was used to quench the same aluminum block after it was reheated. UCON™ is manufactured by Union Carbide Chemicals and Plastics Company, Inc., Specialty Chemicals Division, at Terrytown, N.Y. The thermal cooling experienced at the center of the block was measured, recorded and illustrated in FIG. 6.

As is shown by the gentle slope in FIG. 6, the cooling rate of the center of the block of Example 3 is not as rapid as that of Example 1 or Example 2. During the first 8–9 seconds of quenching, the rate of cooling of the block of Example 3 was slower than that of Example 2. The rate of cooling during this time frame was about 27° F. per second (150° F./5.5 seconds). The center of the block remained above the critical temperature range for a period of time that was about 3.1 times that of cold water (Example 1) and about 1.1 times that of warm water (Example 2). Thus, there is a desirable reduction in residual stresses (as in Example 2) caused by quenching above the critical temperature range.

The gentle slope and gentle quench rate for Example 3 continues well into the critical temperature range. The rate of cooling during the critical temperature range was about 44.4° F. per second (200° F./4.3 seconds). The length of time that the block remains in the critical temperature range ($\Delta t_{20\%}$) is about 2.5 times as longer than cold water (Example 1) and about the same as warm water (Example 2). As explained above, this is considered undesirable and is believed in the art to be associated with reduced mechanical strength in the subsequently aged workpiece. In addition, the rate of cooling of the block of Example 3 remained fairly constant over the course of the 25 seconds as indicated by the straightness of the curve.

Upon removal from the reservoir, the quenched block was coated with a film of polyalkylene glycol. Parts quenched with the solution of Example 3 require cleaning prior to aging.

EXAMPLE 4

The procedure of Example 1 was repeated except that carbon dioxide gas was dissolved in water entering the reservoir used to quench the same aluminum block after it was reheated. The level of carbon dioxide in the reservoir was maintained at approximately 0.1 standard cubic feet (SCF) of $CO_2$ gas per gallon. This amount was dissolved in the cold water by continuously pumping carbonated water into the tank. The thermal cooling experienced at the center of the block was measured, recorded and illustrated in FIG. 6.

Surprisingly, the cooling rate of the center of the block of Example 4 is not as rapid as that of Example 1 (see FIG. 6). The rate of cooling during the portion of the quench above the critical temperature range was about 29° F. per second (150° F./5.2 seconds). The center of the block remained above the critical temperature range for a period of time that was about 2.8 times that of cold water (Example 1). Above the critical temperature, the rate of cooling (quench intensity) for Example 4 was very similar to that of the Examples 2 Thus, there is a desirable reduction in residual stresses (as in Example 2) caused by quenching above the critical temperature range.

Surprisingly, during the critical temperature the rate of cooling of the block of Example 4 increased. The rate of cooling during the critical temperature range was about 62.5° F. per second (200° F./3.2 seconds). The heat transfer rate during the critical temperature range was higher than those of Examples 2 and 3 as illustrated by the relatively steep slope of the curve. The length of time that the block of Example 4 remained in the critical temperature range ($\Delta t_{CO2}$) is less than both $\Delta t_{ww}$ and $\Delta t_{UCON}$. As explained above, this is considered undesirable and is believed in the art to be associated with reduced mechanical strength in the subsequently aged workpiece. The temperature of the center of the block of Example 4 after 20 seconds of cooling was lower than the temperature of the block in the cold water quench of Example 1.

It is to be appreciated that certain features of the present invention may be changed without departing from the present invention. Thus, for example, it is to be appreciated that although the invention has been described in terms of a preferred embodiment in which carbon dioxide gas is dissolved in water, the gases comprehended by the present invention include any gas or chemical that is more volatile than the liquid cooling medium or chemical that releases gases when it comes into contact with a hot surface. Gases that may be used when water is used as the coolant include but are not limited to carbon dioxide, air, oxygen, nitrogen, furnace gas and mixtures thereof. In addition, the invention is not limited to the dissolving of gas. Thus, for example, it is to be appreciated that although the invention has been described in terms of a preferred embodiment in which carbon dioxide gas is dissolved in water, carbonic acid ($H_2CO_3$) may be mixed with water. Carbonic acid is formed by reaction of carbon dioxide with water. Adding carbonic acid to the quenching medium, such as water, will thus have the same effect as dissolving $CO_2$ gas. Furthermore, organic or inorganic carbonates may be used in practicing the current invention. Inorganic carbonates include $CaCO_3$, $K_2CO_3$, $Na_2CO_3$. Inorganic carbonates are considered to be less desirable because of the possibility of mineral deposition from solution.

Whereas the preferred embodiments of the present invention have been described above in terms of carbonation of cold water, it will be apparent to those skilled in the art that the present invention will also be valuable with warm water quenching. In addition, the invention may also be used in conjunction with brine solutions used in the art, such as 3.5% NaCl solution. Furthermore, the invention may also be used in conjunction with organic additives used in the art such as polyvinyl-alcohols, alkylene-glycol, propylene-glycol, ethylene-glycol or glycerol. Those skilled in the art will recognize that the key is the use of a fluid that is capable of dissolving the gas that is employed.

Whereas the preferred embodiments of the present invention have been described above in terms of being especially valuable in the quenching of aluminum alloy parts, it will be apparent to those skilled in the art that the present invention will also be valuable in the quenching of other metals. Metals suitable for use with the present invention are not limited to aluminum and aluminum alloys. Objects formed from other metals such as magnesium, copper, iron, zinc, nickel, cobalt, titanium, and alloys thereof may also benefit from the present invention.

Whereas the preferred embodiments of the present invention have been described above in terms of being especially valuable in the quenching of wrought and forged aluminum and aluminum alloy parts, it will be apparent to those skilled in the art that the method of forming the metal objects is not considered critical to its usefulness. It is contemplated also that the method and apparatus of the present invention will also be valuable in the quenching of metal objects fabricated from other forming processes including casting, rolling, stamping and extruding. In addition, casting may be carried out by squeeze casting, rheocasting, compocasting, casting under a vacuum or casting with positive pressure.

Whereas the preferred embodiments of the present invention have been described above in terms of being especially valuable in producing 7050 aluminum alloy parts, it will be apparent to those skilled in the art that the present invention will also be valuable producing parts made of other aluminum alloys containing about 75 percent or more by weight of aluminum and one or more alloying elements. Among such suitable alloying elements is at least one element selected from the group of essentially character forming alloying elements consisting of manganese, zinc, beryllium, lithium, copper, silicon and magnesium. These alloying elements are essentially character forming for the reason that the contemplated alloys containing one or more of them essentially derive their characteristic properties from such elements. Usually the amounts of each of the elements which impart such characteristics are, as to each of magnesium and copper, about 0.5 to about 10 wt. % of the total alloy if the element is present as an alloying element in the alloy; as to the element zinc, about 0.05 to about 12.0% of the total alloy if such element is present as an alloying element; as to the element beryllium, about 0.001 to about 5.0% of the total alloy if such element is present as an alloying element; as to the element lithium, about 0.2 to about 3.0% of the total alloy if such element is present as an alloying element; and as to the element manganese, if it is present as an alloying element, usually about 0.15 to about 2.0% of the total alloy.

The elements iron and silicon, while perhaps not entirely or always accurately classifiable as essentially character-forming alloy elements, are often present in aluminum alloy in appreciable quantities and can have a marked effect upon the derived characteristic properties of certain alloys containing the same. Iron, for example, which if present and considered as an undesired impurity, is sometimes desirably present and adjusted in amounts of about 0.3 to 2.0 wt. % of the total alloy to perform specific functions in certain alloys. Silicon may also be so considered, and while found in a range varying from about 0.25 to as much as 15%, is found in the range of about 0.3 to 1.5% to perform specific functions in certain alloys. In light of the foregoing dual nature of these elements and for convenience of definition, the elements iron and silicon may, at least when desirably present in character affecting amounts in certain alloys, be properly also considered as character forming alloying ingredients.

Such aluminum and aluminum alloys, which may contain one or more of these essential character forming elements, may contain, either with or without the aforementioned character-forming elements, quantities of certain well known ancillary alloying elements for the purpose of enhancing particular properties. Such ancillary elements are usually chromium, nickel, zirconium, vanadium, titanium, boron, lead, cadmium, bismuth, and occasionally silicon and iron. Also, while lithium is listed above an essential character forming element, it may in some instances occur in an alloy as an ancillary element in an amount within the range outlined above. When one of these ancillary elements is present in the aluminum alloy of the type herein contemplated, the amount, in terms of percent by weight of the total alloy, varies with the element in question but is usually about 0.05 to 0.4%, titanium about 0.01 to 0.25%, vanadium or zirconium about 0.05 to 0.25%, boron about 0.0002 to 0.04%, cadmium about 0.05 to 0.5%, and bismuth or lead about 0.4 to 0.7%.

The aluminum alloys included most preferably the wrought and forged aluminum alloys such as those registered with the Aluminum Association by the designations 2011, 2014, 2017, 2117, 2218, 2616, 2219, 2419, 2519, 2024, 2124, 2224, 2025, 2036, 4032, 6101, 6201, 6009, 6010, 6151, 6351, 6951, 6053, 6061, 6262, 6063, 6066, 6070, 7001, 7005, 7010, 7016, 7021, 7029, 7049, 7050, 7150, 7055, 7075, 7175(b), 7475, 7076, 7178 and other appropriate alloys of similar designation. Of particular interest are the aluminum alloys 2014, 6061, 7050, 7055 and 7075. These aluminum alloys generally include the generic designation 2000 series alloys, 6000 series alloys and 7000 series alloys. The cast alloys treatable by the present invention include most preferably the cast aluminum alloys, such as those designated 222, 242, 295, 296, 319, 336, 355, 356, 357 and 712. These cast alloys generally have the generic designation 200 series alloys, 600 series alloys and 700 series alloys.

It is also to be appreciated that although the invention has been described in terms of quenching metal, the method and apparatus of the present invention may also be employed with metal matrix composites, metal laminates and cermets.

Although the usefulness of the present invention has been described to some extent in terms of reducing the warpage in thin walled metal objects, it is contemplated that the improved cooling rates of the present invention are also be useful in quenching metal objects having smaller width to thickness ratios. Other formed and or machined metal parts that benefit from the present invention include forged aluminum products including aircraft components and aluminum wheel rims, extrusions including extruded tube, shapes and bar, and rolled products including slab, sheet, foil and plate and parts machined from all such fabricated products. The invention is also especially useful for shapes that are difficult to scrub after quenching in solutions containing organic compounds. As explained above, the dissolved gases used in the present invention leave no residue which needs to be washed or cleaned after quenching.

Although the invention has been described in terms of quenching metal by immersing an entire part in the tank, it is not intended to be limited to the full immersion of a part such that it is completely covered by the quench medium.

The invention is intended to include spray quenching and/or progressively dipping a portion of a continuous sheet into the reservoir so that only a portion of the sheet is submerged in the fluid at any given time. In this embodiment, a portion of the sheet, plate or foil (commonly referred to as flat rolled product) is continuously entering and exiting the reservoir simultaneously. The continuous sheet may then be rolled into coils or otherwise processed.

Similarly, the invention is intended to include progressively dipping a portion of an elongated extrusion, casting or forging into the reservoir so that only a portion of the extrusion, casting or forging is submerged in the fluid at any given time. In this embodiment, a portion of the extrusion, casting or forging is continuously entering and exiting the reservoir simultaneously.

It is also contemplated that a variety of concentrations of carbon dioxide or other gas may be useful in practicing the present invention.

It is further contemplated that the apparatus of the current invention can be constructed in a manner different than that shown in the figures. Thus for example, the static mixer 30 need not be located outside vessel 10 (see FIG. 2) thus eliminating the need for conduit 42. In addition, heat pump 48 shown in FIG. 2 may be located outside vessel 10. Furthermore, water entering the pump in FIGS. 2 and 4 need not come from the vessel. The water can flow into the pump from an alternative cold water source which may or may not contain some intentionally dissolved gas.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of quenching a wrought metal object selected from the group consisting of aluminum, iron, magnesium and alloys thereof comprising:

(a) providing a liquid reservoir of coolant which is open to ambient pressure, said liquid having a temperature from about 100° F. to about 180° F. and consisting essentially of water and sufficient quantity of deliberately dissolved carbon dioxide to retard cooling as compared to water of the same temperature without said deliberately dissolved carbon dioxide, the amount of said dissolved carbon dioxide being present from about 0.01 to about 0.10 standard cubic feet of gas per gallon of water, the dissolved carbon dioxide being higher for lower water temperatures and lower for higher water temperatures; and (b) immersing a heated wrought metal object in said liquid reservoir to quench said metal object.

2. The method of claim 1 in which (a) includes providing a reservoir of liquid coolant which is open to ambient pressure and temperature.

3. The method of claim 1 wherein the water temperature is within 120° F. to 160° F.

4. The method of claim 1 which further includes circulating a portion of said liquid coolant to dissolve carbon dioxide into said portion for providing and replenishing said carbon dioxide in said liquid coolant.

5. The method of claim 1 wherein said liquid coolant in said reservoir has a first temperature and additional liquid coolant is added to said reservoir, said additional coolant being cooler than the coolant in the reservoir.

6. The method of claim 1 which further includes:

monitoring the amount of said carbon dioxide dissolved in said liquid coolant; and dissolving additional carbon dioxide into said liquid coolant in response to said monitoring.

7. The method of claim 1 in said metal object has a temperature of about 800° F. to 1,100° F. prior to (b).

8. The method of claim 1 in said metal object has been solution heat treated prior to step (b).

9. The method of claim 1 in said metal object has been hot worked prior to (b).

10. The method of claim 1 in said metal object has been extruded prior to (b).

11. The method of claim 1 in said metal object has been forged prior to (b).

12. A method of heat treating at least one wrought metal object selected from the group consisting of aluminum, iron, magnesium and alloys thereof comprising:

(a) heating at least one wrought metal object to a solution heat temperature of about 800° F. to about 1100° F.; and (b) immersing said heated object in a reservoir of liquid coolant, said liquid coolant having a temperature from about 100° F. to about 180° F. and consisting essentially of water and sufficient quantity of deliberately dissolved carbon dioxide, to retard cooling as compared to water of the same temperature without said deliberately dissolved carbon dioxide, the amount of said dissolved carbon dioxide being present from about 0.01 to about 0.10 standard cubic feet of gas per gallon of water, the dissolved carbon dioxide being higher for lower water temperatures and lower for higher water temperatures, said reservoir having a blanket of carbon dioxide thereover.

13. The method of claim 12 which further includes immersing said heated object in a reservoir of liquid coolant having a temperature in a range of about 120° F. to 160° F.

14. The method of claim 12 which further includes circulating a portion of said liquid coolant through a mixing chamber to dissolve additional carbon dioxide into said portion for providing and replenishing said carbon dioxide in said liquid coolant.

15. The method of claim 12 which includes circulating a portion of said liquid coolant having a first temperature through a mixing chamber and then to said reservoir to add additional dissolved carbon dioxide to said reservoir, said additional portion of said liquid coolant returning to said reservoir having a second temperature lower than said first temperature.

16. The method of claim 12 which further includes circulating a portion of said liquid coolant through a mixing chamber and injecting air into said circulated portion to remove at least a portion of said carbon dioxide from said circulated portion of said liquid, and then conveying said circulated portion of said liquid to said reservoir.

17. The method of claim 12 in which said metal object has been extruded prior to (b).

18. The method of claim 12 in which said metal object has been forged prior to (b).

19. The method of claim 13 in which said metal object has been hot worked prior to (b).

20. The method of claim 12 in which said metal object has been extruded prior to (b) and has different thicknesses across its cross sections.

21. The method of claim 12 in which said metal object has been forged prior to (b) and has different thicknesses across its cross sections.

22. A method of quenching a solid metal object selected from the group consisting of aluminum, iron, magnesium and alloys thereof comprising:

heating a solid metal object to a temperature of 800° F. to 1100° F.; and submerging said solid metal object into a reservoir of carbonated water which is open to the atmosphere, said carbonated water having a temperature from about 100° F. to about 180° F. and consisting essentially of water and sufficient quantity of carbon dioxide dissolved therein to retard the initial cooling of said solid metal object as compared to water of the same temperature without deliberately dissolved carbon dioxide, the amount of said dissolved carbon dioxide being present from about 0.01 to about 0.10 standard cubic feet of gas per gallon of water, the dissolved carbon dioxide being higher for lower water temperatures and lower for higher water temperatures.

23. The method of claim 22 which further includes maintaining said metal object in said reservoir until the temperature of said metal object is below about 300° F.

24. A method of quenching a solid aluminum metal piece in a reservoir of carbonated water consisting essentially of water having a temperature from about 100° F. to about 180° F. and sufficient quantity of deliberately dissolved carbon dioxide as compared to water of the same temperature, the amount of said dissolved carbon dioxide being present from about 0.01 to about 0.10 standard cubic feet of gas per gallon of water, the dissolved carbon dioxide being higher for lower water temperatures and lower for higher water temperatures.

25. A method of quenching a heated solid object formed from an aluminum alloy containing at least 75 percent or more by weight of aluminum, said method comprising:

(a) providing a reservoir of water having a temperature from about 100° F. to about 180° F. and which is open to ambient pressure, said reservoir consisting essentially of water and deliberately dissolved carbon dioxide in which gaseous carbon dioxide has been intentionally dissolved in said water in sufficient quantity to retard cooling of the heated object from a temperature above 600° F. as compared to water of the same temperature, the amount of said dissolved carbon dioxide being present from about 0.01 to about 0.10 standard cubic feet of gas per gallon of water, the dissolved carbon dioxide being higher for lower water temperatures and lower for higher water temperatures; and (b) submerging said solid heated object in said reservoir to quench said material.

26. The method of claim 25 wherein the temperature of said water is within 120° F. to 160° F.

27. The method of claim 25 which further includes circulating a portion of said reservoir through a mixing chamber to dissolve additional carbon dioxide into said water.

28. The method of claim 25 which further includes adding cold water to said reservoir to lower the temperature of the water in said reservoir said cold water consisting essentially of water and dissolved gas which has been intentionally added.

29. A method of quenching a solid object selected from the group consisting of aluminum, iron, magnesium and alloys thereof with a liquid consisting essentially of water having a temperature from about 100° F. to about 180° F. and dissolved carbon dioxide which has been intentionally introduced into said water to retard cooling as compared to water of the same temperature, the amount of said dissolved carbon dioxide being present from about 0.01 to about 0.10 standard cubic feet of gas per gallon of water, the dissolved carbon dioxide being higher for lower water temperatures and lower for higher water temperatures, wherein sad liquid is open to atmospheric pressure and the object is heat treated, said method comprising the steps of:

(a) detecting the amount of carbon dioxide dissolved in the liquid;

(b) comparing said amount of carbon dioxide dissolved in said liquid to a reference range;

(c) controlling the amount of carbon dioxide that is being dissolved in said liquid so that the amount of carbon dioxide in said liquid is maintained within said reference range; and (d) immersing said solid object in said liquid to quench said object.

30. The method of claim 29 in which (a) includes using an infrared spectrometer to detect the amount of dissolved carbon dioxide in said liquid.

31. The method of claim 29 in which (a) includes continuously passing a portion of said liquid through an infrared spectrometer to detect the amount of carbon dioxide dissolved in said liquid.

32. The method of claim 29 in which (c) includes reducing the relative amount of carbon dioxide that is being dissolved in said liquid if the detected amount of carbon dioxide is more than said reference range.

33. The method of claim 29 in which (c) includes using pressurized air to strip at least some of said dissolved carbon dioxide from said liquid if the detected amount of carbon dioxide is more than said reference range.

34. The method of claim 29 in which (c) includes increasing the relative amount of carbon dioxide that is being dissolved in said liquid if the detected amount of carbon dioxide is less than said reference range.

35. A method of solution heat treating solid metal objects selected from the group consisting of aluminum, iron, magnesium and alloys thereof comprising the steps of:

(a) heating solid metal objects to a solution heat treatment temperature;

(b) providing water;

(c) dissolving carbon dioxide in said water under pressure and then releasing said pressure to form a liquid coolant consisting essentially of water having a temperature from about 100° F. to about 180° F. and carbon dioxide dissolved therein, the amount of said dissolved carbon dioxide being present from about 0.01 to about 0.10 standard cubic feet of gas per gallon of water, the dissolved carbon dioxide being higher for lower water temperatures and lower for higher water temperatures;

(d) generating a signal which is related to the amount of carbon dioxide dissolved in said liquid coolant;

(e) comparing said amount of carbon dioxide dissolved in said liquid coolant to a reference range;

(f) controlling the amount of carbon dioxide that is being dissolved in said liquid coolant so that the amount of carbon dioxide in said solution is within said reference range; and (g) immersing said solid heated metal objects in said liquid coolant to quench said metal objects.

36. The method of claim 35 in which said metal objects is an aluminum alloy.

37. The method of claim 35 in which (c) includes introducing pressurized carbon dioxide into said liquid at a pressure which is greater than atmospheric pressure.

38. The method of claim 35 in which said metal objects are made from heat treatable aluminum alloys.

39. The method of claim 35 in which said metal objects are quenched one at a time.

40. An improved method of solution heat treating a solid metal object selected from the group consisting of aluminum, iron, magnesium and alloys thereof in a liquid, the improvement comprising the steps of:

(a) providing a liquid consisting essentially of water having a temperature from about 100° F. to about 180° F. and deliberately dissolved carbon dioxide which has been deliberately introduced into said liquid, the amount of said dissolved carbon dioxide being present from about 0.01 to about 0.10 standard cubic feet of gas per gallon of water, the dissolved carbon dioxide being higher for lower water temperatures and lower for higher water temperatures, said liquid being open to ambient pressure;

(b) generating a signal which is related to the amount of carbon dioxide dissolved in a liquid;

(c) comparing said generated signal to a reference range;

(d) controlling the amount of carbon dioxide that is dissolved in said liquid so that the amount of carbon dioxide in said solution is within said reference range; and (e) immersing said heated solid metal object in said liquid to quench said metal object.

41. The method of claim 40 in which said metal object is an aluminum alloy.

42. A method of quenching a solid metal part fabricated from an alloy containing at least about 75 wt. % aluminum, said method comprising:

(a) providing water reservoir open to ambient pressure having a temperature from about 100° F. to about 180° F. and consisting essentially of water and deliberately dissolved carbon dioxide gas which has been intentionally dissolved therein, the amount of said dissolved carbon dioxide being present from about 0.01 to about 0.10 standard cubic feet of gas per gallon of water, the dissolved carbon dioxide being higher for lower water temperatures and lower for higher water temperatures;

(b) periodically generating a signal which is related to the amount of carbon dioxide that is dissolved in said water reservoir, said signal generated using an infrared spectrometer;

(c) comparing said generated signal to a reference range;

(d) controlling the amount of carbon dioxide that is dissolved into said water reservoir so that the amount of gas in said solution is within said reference range; and (e) quenching said metal part in said water reservoir.

43. The method of claim 42 in which steps (b) through (d) are repeated while simultaneously immersing said formed metal part in said water reservoir to quench said formed metal part.

44. A method of quenching a solid metal article selected from the group consisting of aluminum, iron, magnesium and alloys thereof comprising immersing said metal article in a coolant that cools said article during a first time period at a rate of cooling approximating the cooling rate of warm water and during a second period of time at a second rate of cooling which is faster than that of warm water, said method comprising providing a reservoir of water having a temperature from about 100° F. to about 180° F. and; and deliberately dissolving gas in said reservoir, the amount of said dissolved carbon dioxide being present from about 0.01 to about 0.10 standard cubic feet of gas per gallon of water, the dissolved carbon dioxide being higher for lower water temperatures and lower for higher water temperatures.

45. The method of claim 44 in which some of said dissolved gas comes out of said coolant during said first time period and creates vapor and gas films which cover a surface of said metal object to form an insulation blanket during said first period of time, and said insulation blanket disperses during second subsequent period of time.

46. A method of quenching a solid metal object selected from the group consisting essentially of aluminum, iron, magnesium and alloys thereof comprising:

(a) providing an open reservoir consisting essentially of water having a temperature from about 100° F. to about 180° F. and carbon dioxide which has been intentionally dissolved therein, the amount of said dissolved carbon dioxide being present from about 0.01 to about 0.10 standard cubic feet of gas per gallon of water, the dissolved carbon dioxide being higher for lower water temperatures and lower for higher water temperatures; and (b) immersing a solid metal object in said reservoir to quench metal.

47. A method of quenching wrought metal objects selected from the group consisting of aluminum, iron, magnesium and alloys thereof comprising:

(a) placing water under pressure:

(b) injecting pressurized carbon dioxide gas into said pressurized water to form a pressurized mixture of water and carbon dioxide gas;

(c) mixing said mixture of water and carbon dioxide gas to dissolve said gas in said water;

(d) forming a bath having a temperature from about 100° F. to about 180° F. from said mixture of water and carbon dioxide deliberately dissolved therein, the amount of said dissolved carbon dioxide being present from about 0.01 to about 0.10 standard cubic feet of gas per gallon of water, the dissolved carbon dioxide being higher for lower water temperatures and lower for higher water temperatures, said bath being open to ambient atmospheric conditions to permit some gas to escape from said bath and having a blanket of gaseous carbon dioxide over said bath to retard said escape; and (e) immersing heated wrought metal objects one or more at a time in said liquid bath to quench said wrought metal objects.

48. A method of quenching a wrought metal object selected from the group consisting of aluminum, iron, magnesium and alloys thereof comprising:

(a) providing a bath of water which is open to ambient atmospheric conditions, (b) removing a portion of said bath and injecting pressurized carbon dioxide gas into said portion under pressure to form a pressurized mixture of water and carbon dioxide gas;

(c) mixing said pressurized mixture and thereby form an aqueous solution consisting essentially of water having a temperature from about 100° F. to about 180° F. and deliberately dissolved carbon dioxide gas, the amount of said dissolved carbon dioxide being present from about 0.01 to about 0.10 standard cubic feet of gas per gallon of water, the dissolved carbon dioxide being higher for lower water temperatures and lower for higher water temperatures;

(d) introducing said aqueous solution into said bath;

(e) performing (b)–(d) to maintain the level of dissolved carbon dioxide gas at a predetermined value; and (f) immersing heated wrought metal object in said bath one or more at a time to quench said wrought metal object.

49. A method of quenching a wrought metal object selected from the group consisting of aluminum, iron, magnesium and alloys thereof in an aqueous solution, said method comprising:

(a) providing a bath which is open to ambient pressure consisting essentially of water having a temperature from about 100° F. to about 180° F. and $CO_2$ which has been intentionally dissolved into said liquid, the amount of said dissolved carbon dioxide being present from about 0.01 to about 0.10 standard cubic feet of gas per gallon of water, the dissolved carbon dioxide being higher for lower water temperatures and lower for higher water temperatures; and (b) immersing a heated wrought metal object in said bath to quench said metal object, during said immersion the cooling rate of said metal object is influenced as follows:

(i) said bath forming a water vapor and $CO_2$ gas layer on surfaces of said metal object in response to said bath contacting the hot surface of said metal object while it is above critical temperature, said vapor and gas layer partially insulating said metal from said bath and thereby retarding said cooling rate, said vapor and gas layer continually being replaced by a new layer that continues to be formed so long as the metal object is above a critical temperature; and (ii) as said metal object cools, the rate of new water vapor and gas generation decreases and said vapor and gas insulation layer gradually deteriorates so said bath makes direct contact with said surface of said metal object when its temperature falls below said critical temperature so that the cooling rate approximates that of a water bath that does not contain intentionally dissolved $CO_2$ gas when said object is below said critical temperature.

50. A method of quenching wrought metal objects selected from the group consisting of aluminum, iron, magnesium and alloys thereof comprising:

providing a large open bath of water at atmospheric pressure having a temperature in a range from about 100° F. to about 180° F. and containing carbon dioxide which has been dissolved in the water by mixing pressurized carbon dioxide into a portion of said bath which is fed from the bath through a pressurized mixer and returned to the bath;

controlling said mixing to maintain essentially single phase bath of water and dissolved $CO_2$ in sufficient quantity to retard cooling of said metal objects during the initial portion of quenching, the amount of said dissolved carbon dioxide being present from about 0.01 to about 0.10 standard cubic feet of gas per gallon of water, the dissolved carbon dioxide being higher for lower water temperatures and lower for higher water temperatures; and immersing heated wrought metal objects one or more at a time in said bath to quench them.

51. A method as set forth in claim 50 in which the water in said bath is saturated with $CO_2$.

52. A method as set forth in claim 50 in which said water is in a range of about 120° to 160° F.

53. A method as set forth in claim 50 in which said objects are initially cooled to approximately 600° F. at a rate less than the rate of cooling using water of like temperature which does not contain intentionally dissolved $CO_2$, and then cooled at a rate that approximates the rate of cooling of like-temperature water that does not contain intentionally dissolved $CO_2$.

54. The method of claim 46 in which carbon dioxide has been dissolved in said reservoir of liquid coolant by injecting carbon dioxide into said coolant.

55. The method of claim 46 in which step (a) includes providing a reservoir of liquid coolant which is open to ambient pressure and temperature.

* * * * *